US008387641B1

(12) United States Patent
Ilan et al.

(10) Patent No.: US 8,387,641 B1
(45) Date of Patent: Mar. 5, 2013

(54) MOTOR OPERATED WHEELCHAIR UMBRELLA

(76) Inventors: Nily Ilan, Clearwater, FL (US); Uri Ilan, Clearwater, FL (US)

( * ) Notice: Subject to any disclaimer, the term of this patent is extended or adjusted under 35 U.S.C. 154(b) by 102 days.

(21) Appl. No.: 13/082,445

(22) Filed: Apr. 8, 2011

(51) Int. Cl.
*E04H 15/02* (2006.01)

(52) U.S. Cl. ..... 135/96; 135/34.2; 135/88.03

(58) Field of Classification Search ..... 135/88.01, 135/88.02, 88.03, 88.07, 34.2, 20.1; 224/407; 297/184.1, 184.11, 184.15, 184.16
See application file for complete search history.

(56) References Cited

U.S. PATENT DOCUMENTS 3,622,201 A * 11/1971 Radig ..... 297/184.14
3,935,874 A * 2/1976 Cohen ..... 135/16
4,023,582 A 5/1977 Buzzella et al.
4,433,699 A * 2/1984 Schultes et al. ..... 135/15.1
4,543,971 A * 10/1985 Sirota ..... 135/16
4,836,232 A 6/1989 De Rosa et al.
5,010,939 A * 4/1991 King ..... 160/84.07
5,318,055 A * 6/1994 Olaniyan ..... 135/16
6,192,967 B1 * 2/2001 Huang ..... 160/370.23
6,244,286 B1 6/2001 Russo
6,308,722 B1 10/2001 Christie
6,845,780 B2 1/2005 Bishirjian
7,069,939 B1 * 7/2006 Conde ..... 135/16
7,690,389 B2 4/2010 Barreiro
7,861,735 B2 1/2011 Stepaniuk et al.
2008/0236640 A1 * 10/2008 Huali et al. ..... 135/20.3
2010/0101614 A1 * 4/2010 Wang et al. ..... 135/20.1

* cited by examiner

*Primary Examiner* — Noah Chandler Hawk
(74) *Attorney, Agent, or Firm* — David Kiewit

(57) ABSTRACT

An electrically-operated personal canopy apparatus is configured for attachment to the back of a wheelchair to provide rain protection for a user. The movements of various mechanical elements of the apparatus are controlled so that a single user input causes a free end of a spine to extend from a storage container to a position above the user and a fan-fold canopy to then open.

4 Claims, 7 Drawing Sheets

MOTOR OPERATED WHEELCHAIR UMBRELLA

BACKGROUND OF THE INVENTION

The invention relates to canopies and canopy-operating mechanisms supported by or intended for support by a vehicle. More particularly, preferred embodiments of the invention relate to apparatus for deploying a canopy above an occupant seated in a wheelchair.

BACKGROUND INFORMATION

In U.S. Pat. No. 6,845,780 Bishirjian teaches a radially foldable canopy supported by two telescoping spines attached to the back of a chair.

In U.S. Pat. No. 7,861,735 Stepaniuk et al. teach a motor-driven arrangement for moving a canopy between a deployed position above a wheelchair and a stowed position.

BRIEF SUMMARY OF THE INVENTION

One aspect of the invention is that it provides a personal canopy apparatus attachable to a wheelchair or other mobility assistance device and operable by a disabled occupant. The personal canopy apparatus may comprise a fixed support attachable to the back of the wheelchair and an electrically operable canopy storage and deployment arrangement. This arrangement may comprise an arctuate spine coupled to the fixed support adjacent a first of two ends of the spine. A first actuator, which is preferably an electric motor, can be used to move the spine between a retracted position in which the second, free, end of the spine is adjacent the support; and an extended position in which the free end of the spine is distal from the support. In addition, the apparatus may comprise a collapsible fan-fold canopy comprising at least one flexible cover and a plurality of battens. Each of these battens is attached to the cover and has a respective mounted end pivotally connected to the spine at or near the free end. A second electric actuator, which is also preferably an electric motor, is coupled to at least two of the battens and is operable to move the canopy between a collapsed state in which the plurality of battens are disposed along the spine and a deployed state in which the outer ends of the battens are spaced apart.

Another aspect of the invention is that it provides a personal canopy apparatus comprising a storage container, an elongated support spine, a central cap, a collapsible canopy, at least two electric motors and a control mechanism for sequencing the operations of the motors responsive to a user's command. The storage container is preferably attachable to the back of a seating apparatus, such as a wheelchair or mobility scooter. The elongated spine has two ends and is preferably more or less completely received within the storage container when the spine is in a lowered state. The spine extends outwardly from the storage container when in a raised state. A central cap is preferably attached to the spine adjacent the end of the spine distal from the storage container when the spine extends outwardly. The central cap may be in a sealing relation with the storage container when the spine is in its lowered state. In addition, there is a collapsible canopy that has at least two free edges. This canopy consists of at least one flexible cover attached to a plurality of battens radially disposed about the central cap when the canopy is in an open state. In this open state the two free edges of the canopy are adjacent. When the canopy is closed, on the other hand, the battens are received within a channel portion of the spine. A first electric motor is drivingly coupled between the storage container and the spine, preferably by use of a regulator mechanism of the type used to raise and lower automotive windows. This motor is operable to move the spine between its raised and lowered states. A second electric motor is located within the central cap and is coupled to at least two driven ones of the battens. These driven batters are respectively adjacent respective ones of the two free edges of the canopy. The second motor can act on the driven battens and thereby pivot all the battens into a radially separated array characterizing the open state of the canopy. A control mechanism is preferably provided to coordinate the movements of various mechanical elements of the apparatus so that a single user input results in either a selected deployment or a selected stowage of the canopy, rather than leading to a jammed mechanism. In this regard, a preferred control mechanism is operable to control the first and second motors responsive to a user's input so that if the spine is in the lowered state and an operator input to open the canopy is received, the first motor moves the spine to the raised state and then the second motor opens the canopy. On the other hand, if the canopy is open and an operator input to close the canopy is received, the second motor closes the canopy and then the first motor lowers the spine.

An object of the invention is to provide a fully-adjustable, battery-powered umbrella that is lightweight, easily controlled, and that can be folded away in a compact storage container when not in use. A more specific object of the invention is to provide such an umbrella for use with an electrically powered wheelchair or other mobility apparatus.

Those skilled in the art will recognize that the foregoing broad summary description is not intended to list all of the features and advantages of the invention. Both the underlying ideas and the specific embodiments disclosed in the following Detailed Description may serve as a basis for alternate arrangements for carrying out the purposes of the present invention and such equivalent constructions are within the spirit and scope of the invention in its broadest form. Moreover, different embodiments of the invention may provide various combinations of the recited features and advantages of the invention, and that less than all of the recited features and advantages may be provided by some embodiments.

DETAILED DESCRIPTION OF A PREFERRED EMBODIMENT

In studying this Detailed Description, the reader may be aided by noting definitions of certain words and phrases used throughout this patent document. Wherever those definitions are provided, those of ordinary skill in the art should understand that in many, if not most, instances such definitions apply both to preceding and following uses of such defined words and phrases.

Figure 1:
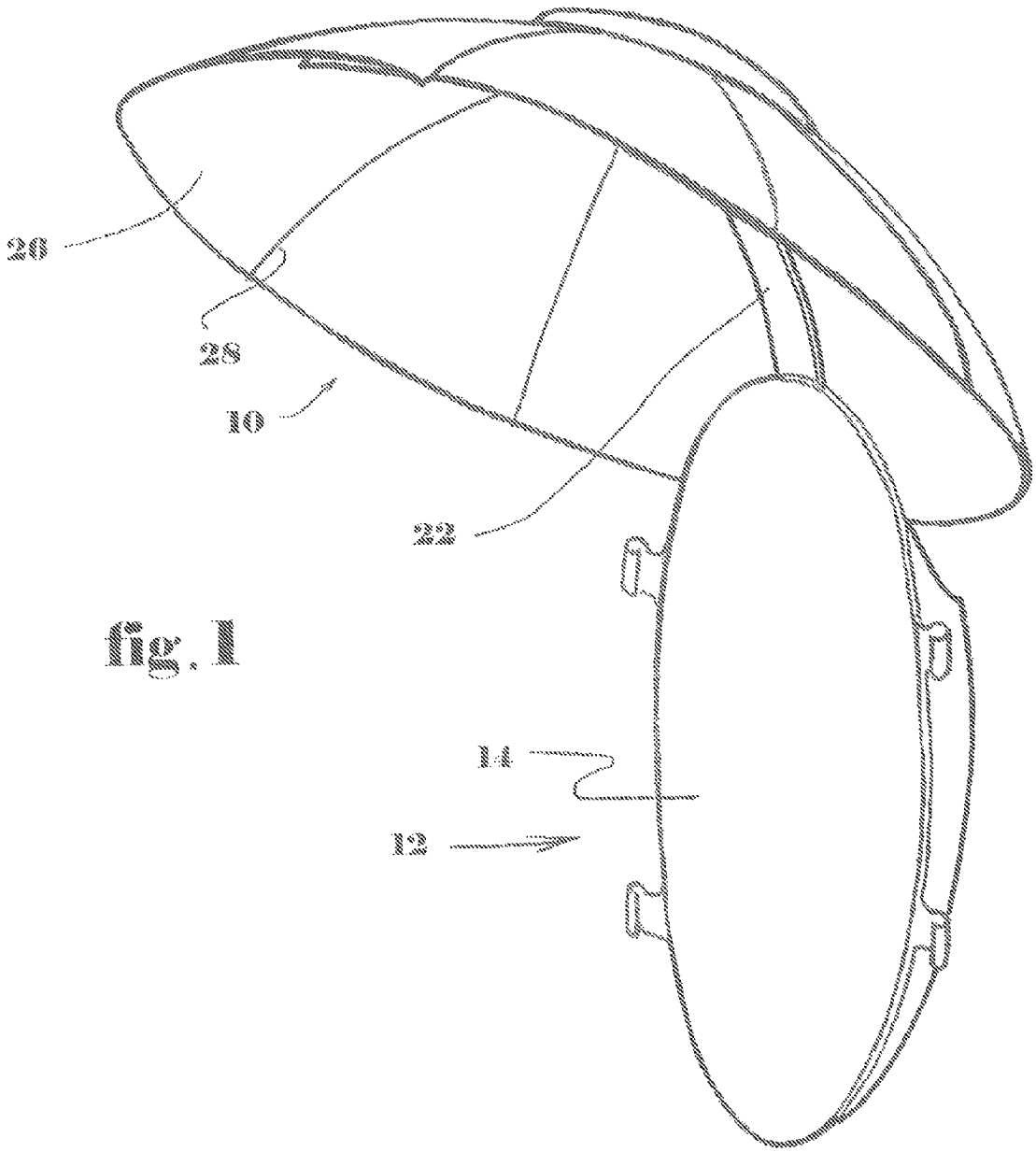
FIG. 1 is a perspective view of a deployed canopy and its storage container.

Turning now to FIG. 1, one finds apparatus of the invention 8 comprising a canopy 10 and storage container 12 of the invention. The preferred storage container 12 provides a flat support plate 14 that can be clamped, belted, hooked, or otherwise attached to a seating apparatus such as an electrically powered wheelchair 16. The support plate 14 and the back portion 18 of the preferred container provide a semi-ovoid storage volume for holding a folded canopy 10.

It may be noted that although the preferred embodiment provides for storage of the collapsed canopy, this is not essential to the functioning of the apparatus. Some sort of support member, such as a combination of a support plate 14 attached to the seating apparatus 16 and a fixed track 20 attached to the support plate is used to provide a stationary portion of the mechanism that extends and retracts a spine 22. Various design approaches may be used for the stationary portion of the mechanism. In addition to the arrangement depicted in FIG. 2, these comprise, without limit, tracks or track supports that are pivotally attached to a support so that the bottom of the track can be moved toward and away from the back of the wheelchair in order to adjust the height of the free end of the spine and thus provide suitable headroom for the occupant of the chair.

A preferred canopy 10 has a maximum span of thirty seven to forty inches and is held above the storage container (and, more importantly, above the head of an occupant 24 of a wheelchair) by an arctuate spine 22. The canopy 10 is preferably positioned so that a portion of the canopy extends rearwardly over the storage container 12 so as to ensure that the user's back is shielded. In some embodiments the deployed canopy has a generally elliptical shape with some distortion at the rearward portion where the canopy cover 26 material is attached to the spine 22.

The preferred canopy cover 26 is made from one or more sheets of durable, flexible elastic material having a plurality of battens 28 attached to it by conventional means. In one preferred embodiment, the cover material is a nylon fabric and the battens 28, which are aluminum slats, are sewn to the cover.

Although the exemplar battens are made of aluminum the reader will recognize that many other metals and plastics can be used for this function.

Figure 2:
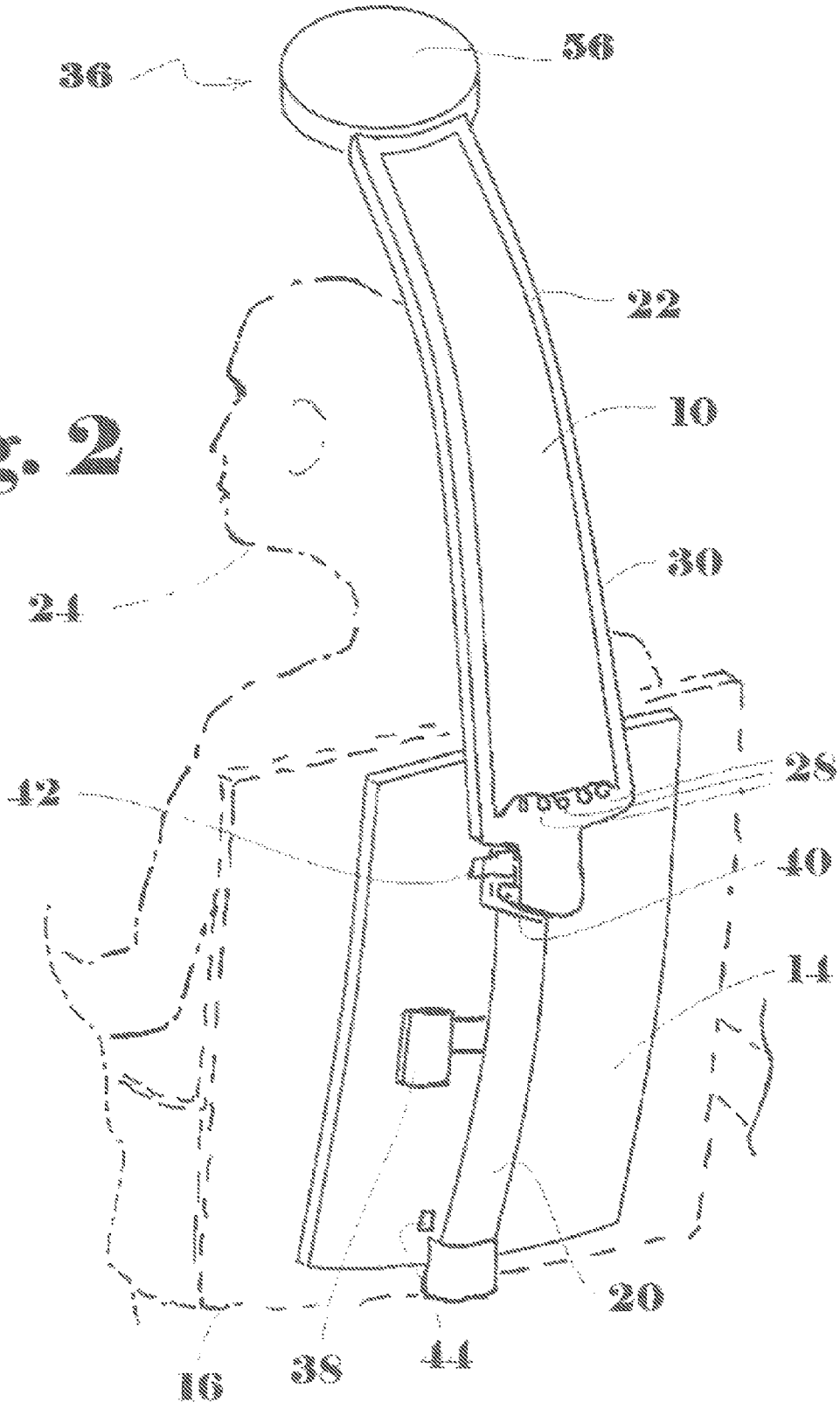
FIG. 2 is a rear perspective view of a collapsed canopy stowed within a channel portion of a spine.

The preferred spine 22 is an arctuate channel, as generally depicted in FIG. 2. In this arrangement the channel sidewalls 30 strengthen the spine and aid in storage of the canopy 10 when it is in its collapsed state. A first end 32 of the spine, which is the lower end when the apparatus is in use, is coupled to the support member 14. The second 34, free, end of the preferred spine is attached to a cap member 36.

In experimental models, the spine has been fabricated from sheet aluminum, but its construction is not so limited. Various other metals and polymeric materials could be used to form this element of the apparatus.

The spine 22 may be coupled to the support 14 by various mechanisms. In an experimental embodiment this was done using a single channel Bowden cable driven automotive window regulator comprising a reversible spine-drive motor 38; a traveler 40 driven by the cable and pivotally attached to the spine; a track; and upper 42 and lower 44 limit switches.

It should be recognized that many configurations for the spine extension and retraction mechanism are possible. Alternatives include, without limit, scissor-type automotive window regulators, various chain and sprocket drives and a lead screw mounted on an intermediary support pivotally attached to a support plate. The preferred spine is a single element.

Figure 3:
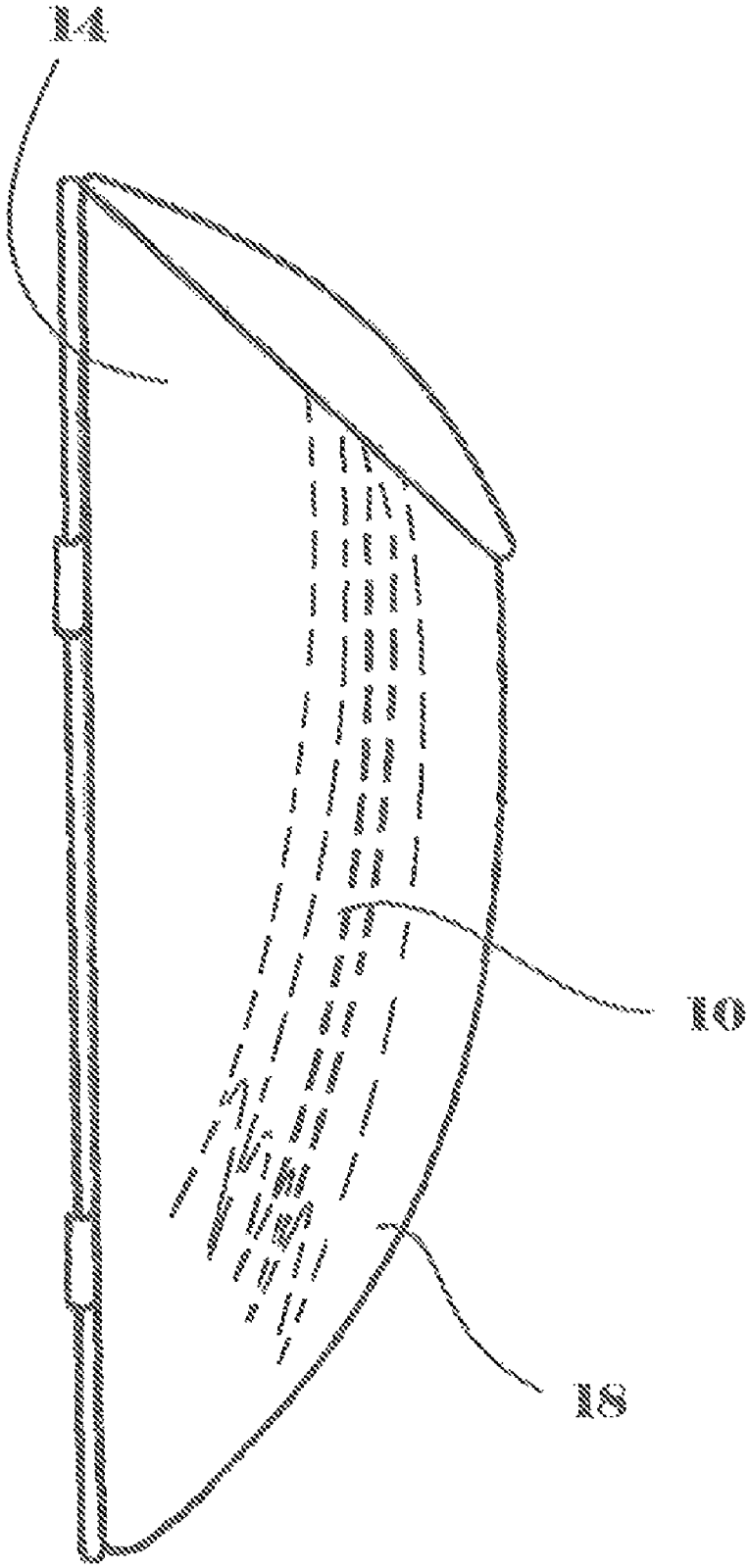
FIG. 3 is a left hand view of a storage container holding a stowed canopy.
Figure 4:
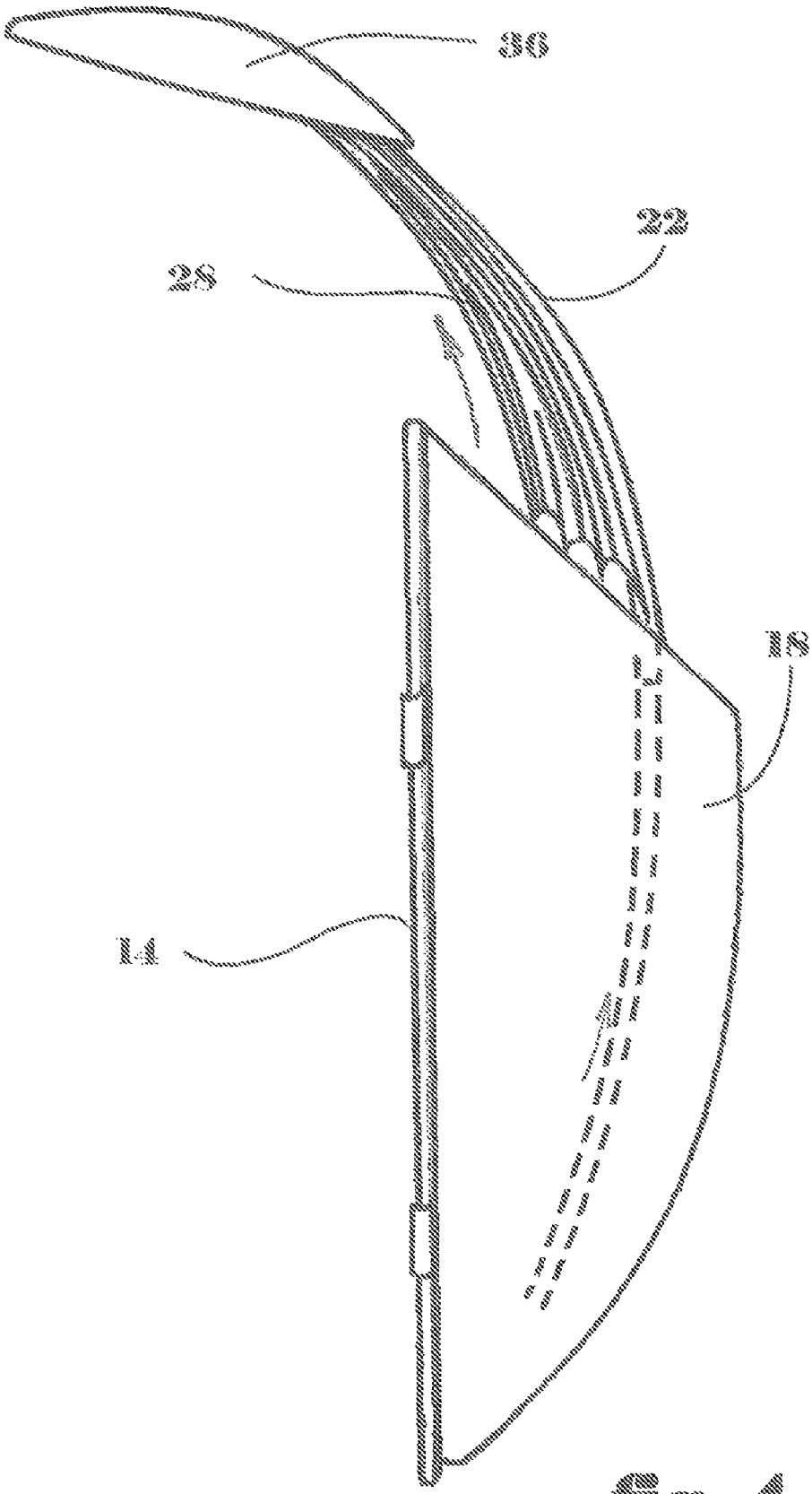
FIG. 4 is a left hand view of a partially deployed canopy extending upwards from a storage container.

In a preferred embodiment the spine 22 and collapsed canopy 10 (shown in phantom in FIG. 3) are stored in a semi-ovoid container 12. In some storage arrangements the cap 36 portion of the apparatus may be in a sealing engagement with an upper portion of the storage container when the canopy is collapsed and completely stowed. In preferred arrangements, when the canopy is stored the battens 28 extend along the spine and are received within a channel-like portion of the spine.

A preferred cap portion 36 of the apparatus comprises a lower, downward facing chamber 46 containing an electric canopy motor 48, an upper chamber 50 containing drive gears 52, 54 and a more or less centrally supported lid 56 spaced apart from the floor of the upper chamber so as to provide clearance for motion of the canopy battens 28. The preferred cap is preferably fixedly attached to the spine 22 at its free end 34

Figure 5:
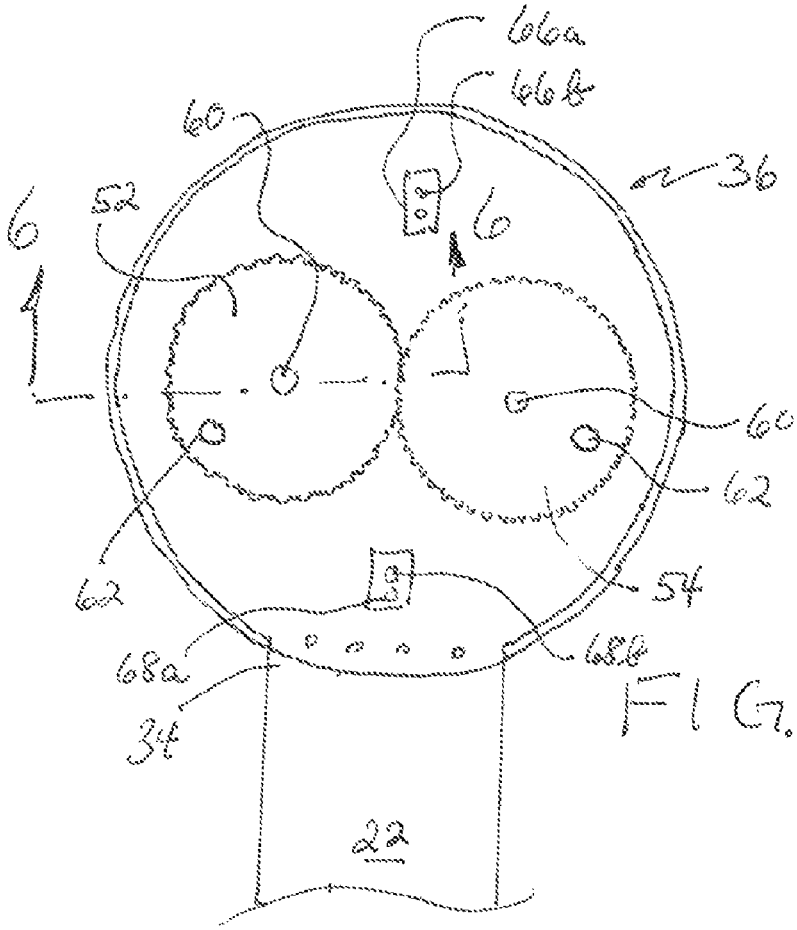
FIG. 5 is a plan view of a central cap member from which a lid has been removed, the view depicting a portion of a canopy deploying mechanism
Figure 6:
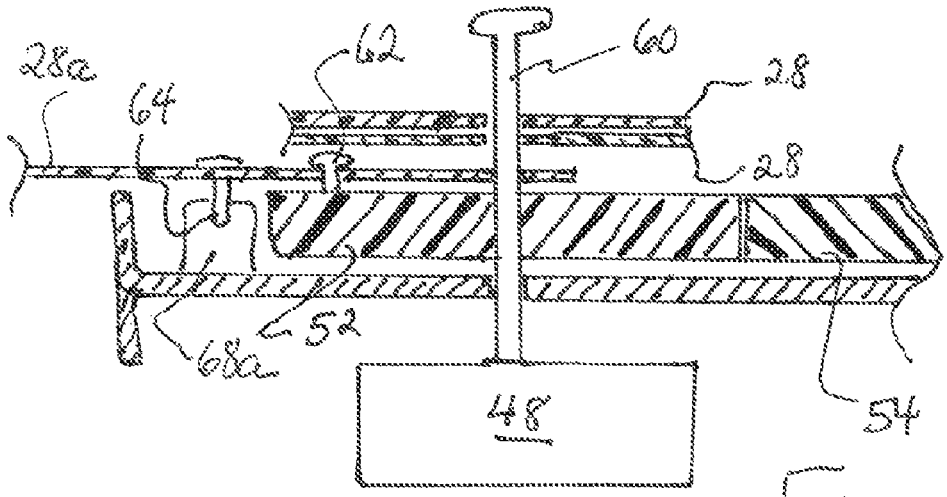
FIG. 6 is a sectional detail view of the cap of FIG. 5, the section taken as indicated by the arrows 6-6 in FIG. 5
Figure 7:
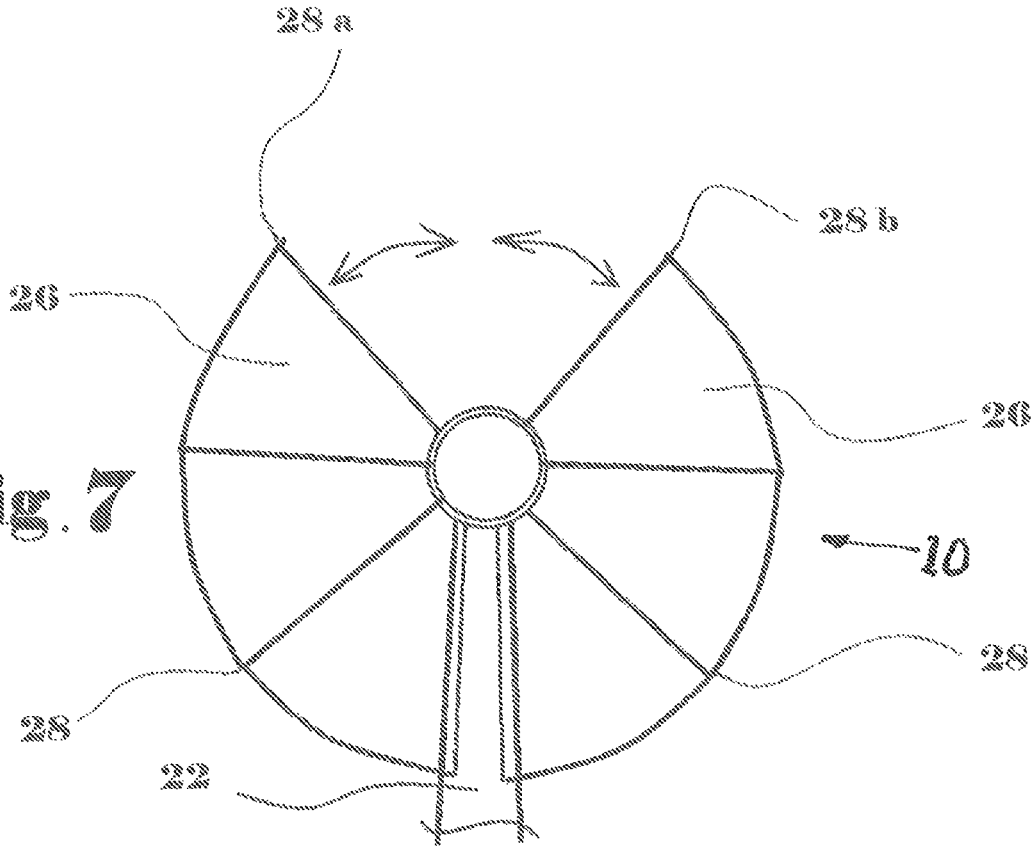
FIG. 7 is a plan view of a partially opened canopy.
Figure 8:
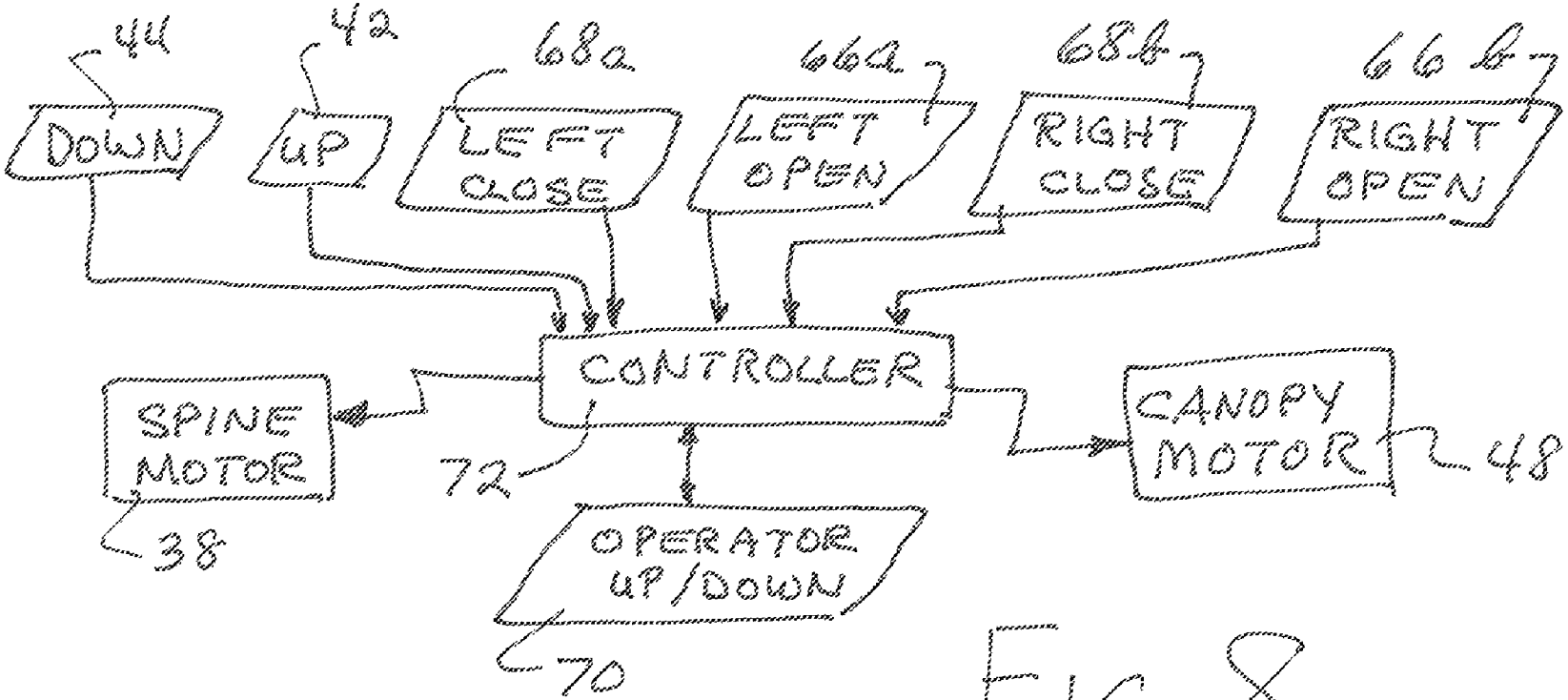
FIG. 8 is a block diagram of preferred control elements of the apparatus.

The preferred fan-fold canopy is moved between its open and closed states by an electric actuator disposed in the cap portion 36 of the apparatus. In the configuration depicted in FIGS. 5 and 6 the actuator is a canopy drive motor 48 directly coupled to a first spur gear 52 that drives a second spur gear 54 in opposite rotational directions.

The canopy 10 may comprise two covers 26 having respective rear edges attached to the spine and respective forward, or free, edges attached to respective drive battens 28*a*, 28*b*. Each of the drive battens 28*a*, 28*b* has a mounted end 58 pivotally attached to a respective gear shaft 60 and fixedly attached (e.g., by a pin 62) to the respective gear at a second point. Thus, when the canopy motor 48 turns, the drive battens 28*a*, 28*b* rotate with the gears 52, 54. Each of the other battens 28 attached to one of the covers has its mounted end pivotally attached about the associated gear shaft 60. Thus, when the drive batten 28*a*, 28*b* is moved to open the canopy the cover 26 drags the other battens along so that the battens are radially disposed about the cap and have their outer ends spaced apart along the rim of the canopy.

When the canopy is fully open a peg 64 attached to one of the drive battens hits a respective full-open limit 66*a*, 66*b* switch, which turns off the canopy drive motor 48. Similarly, when the canopy is to be closed, the canopy motor 48 turns in the opposite direction so that each drive batten pushes the other battens toward a closed configuration until the peg 64 attached to each of the drive battens trips a respective 68*a*, 68*b* canopy-close limit switch.

The skilled artisan will recognize that other approaches can be taken to open and close a fan-folded canopy. These approaches include, but are not limited to using a single motor to drive both the spine and canopy by means of a suitable flexible driveshaft and transmission. Moreover, one could consider separate electric motors to drive each of two halves of a canopy.

A preferred control arrangement provides for proper sequencing of the spine extension/retraction and canopy opening/closing functions. In an experimental embodiment the sequencing control was provided directly by a set of six limit switches 42, 44, 66*a*, 66*b*, 68*a*, 68*b*. In this arrangement when the operator uses a control switch 70 to actuate the 'up' switch function to deploy a stowed canopy the spine drive motor 38 extends the spine 22 until the spine traveler 40 hits the up-limit switch 42, at which time the spine drive motor 38 is turned off and the canopy motor 48 is turned on to drive the canopy toward the open position in which the canopy-open limit switches 66*a*, 66*b* are tripped to shut off the canopy drive motor 48. Correspondingly, when the open canopy is to be stowed, the canopy motor 48 drives the drive battens 28*a*, 28*b* towards a stowed position until the canopy-closed switches 68*a*, 68*b* are tripped at which time the canopy motor 48 shuts down and the spine drive motor 38 turns on to retract the spine 22 until the spine-retracted limit switch 44 is tripped.

In other embodiments the addition of a programmable controller 72 is envisioned to provide enhanced safety and improved deployment and storage synchronization. In versions of the apparatus having a complete storage container, it is necessary that the free ends of the canopy battens be clear of the top of the container before canopy deployment is begun. Correspondingly, it is necessary that the canopy be fully closed before the spine is withdrawn into the container.

Although the present invention has been described with respect to several preferred embodiments, many modifications and alterations can be made without departing from the invention. Accordingly, it is intended that all such modifications and alterations be considered as being within the spirit and scope of the invention as defined in the attached claims.

The invention claimed is:

1. A personal canopy apparatus movable between an open and a stored state, the apparatus comprising:

a storage container;

a single-element elongated arctuate spine having two ends, the spine received within the storage container in the stored state and extending outwardly from the storage container in the open state;

a central cap attached to the spine adjacent the end of the spine that is distal from the storage container when the spine extends outward therefrom;

a collapsible canopy having at least two free edges, the canopy comprising at least one flexible cover attached to a plurality of battens radially disposed about the central cap when the canopy is in the open state and the two free edges of the canopy are adjacent each other, the canopy received within the storage container with the battens extending along the spine when the canopy apparatus is in the stored state;

a first electric motor drivingly coupled between the storage container and the spine and operable to extend and retract the spine;

a second electric motor disposed within the central cap, the second electric motor drivingly coupled to two drive battens of the plurality of battens, each drive batten respectively adjacent a respective one of the two free edges, the second motor operable to pivot the at least two driven battens so as to selectively open and close the canopy; and a control mechanism operable to control the first and second motors to move the canopy apparatus between the open and the stored states.

2. The personal canopy apparatus of claim 1 wherein the spine comprises a channel in which the battens are received when the canopy is in the stored state.

3. The personal canopy apparatus of claim 1 wherein the second electric motor is coupled to the two drive battens by respective gear wheels, wherein each drive batten is fixedly radially attached to a respective one of the gear wheels.

4. The personal canopy apparatus of claim 1 wherein the control mechanism comprises a plurality of limit switches.

* * * * *